US009719159B2

(12) United States Patent
Lin et al.

(10) Patent No.: US 9,719,159 B2
(45) Date of Patent: Aug. 1, 2017

(54) MIXED MAGNETIC POWDERS AND THE ELECTRONIC DEVICE USING THE SAME

(71) Applicant: CYNTEC CO., LTD., Hsinchu (TW)

(72) Inventors: Lu-Kuei Lin, New Taipei (TW); Shih-Feng Chien, Hsinchu County (TW); Po-I Wu, Taipei (TW)

(73) Assignee: CYNTEC CO., LTD., Hsinchu (TW)

( * ) Notice: Subject to any disclaimer, the term of this patent is extended or adjusted under 35 U.S.C. 154(b) by 175 days.

(21) Appl. No.: 14/693,956

(22) Filed: Apr. 23, 2015

(65) Prior Publication Data

US 2016/0086715 A1 Mar. 24, 2016

Related U.S. Application Data

(60) Provisional application No. 62/054,388, filed on Sep. 24, 2014, provisional application No. 62/079,573, filed on Nov. 14, 2014.

(51) Int. Cl.

| | |
|---|---|
| ***H01F 27/24*** | (2006.01) |
| ***H01F 5/00*** | (2006.01) |
| ***C22C 38/32*** | (2006.01) |
| ***C22C 45/02*** | (2006.01) |
| ***C22C 38/34*** | (2006.01) |
| ***H01F 1/153*** | (2006.01) |
| ***H01F 17/04*** | (2006.01) |

(52) U.S. Cl.

CPC ..... *C22C 38/32* (2013.01); *C22C 38/34* (2013.01); *C22C 45/02* (2013.01); *H01F 1/153* (2013.01); *H01F 1/15375* (2013.01); *H01F 5/00* (2013.01); *H01F 17/04* (2013.01); *H01F 27/24* (2013.01); *H01F 2017/048* (2013.01)

(58) Field of Classification Search

CPC ..... H01F 5/00; H01F 27/00–27/30
USPC ..... 336/65, 83, 200, 232–234
See application file for complete search history.

(56) References Cited

U.S. PATENT DOCUMENTS

| | | | | |
|---|---|---|---|---|
| 6,340,164 | B1 * | 1/2002 | Borel | A43B 5/1641 280/11.221 |
| 2013/0200970 | A1 * | 8/2013 | Ogawa | H01F 41/098 336/83 |
| 2013/0249662 | A1 * | 9/2013 | Tonoyama | H01F 27/255 336/200 |
| 2014/0266533 | A1 * | 9/2014 | Liao | H01F 17/04 336/175 |

* cited by examiner

*Primary Examiner* — Tuyen Nguyen
(74) *Attorney, Agent, or Firm* — Min-Lee Teng; Litron Patent & Trademark Office

(57) ABSTRACT

Mixed magnetic powders for making a magnetic core or body is disclosed, wherein the mixed magnetic powders comprises: a first magnetic powder; a second magnetic powder, wherein the first magnetic powder and the second magnetic powder are made of a same soft magnetic material, wherein the ratio of the D50 of the first magnetic powder to the D50 of the second magnetic powder is in the range of 5 to 12, wherein the first magnetic powder weighs 50 to 90 percent of the total weight of the first magnetic powder and the second magnetic powder; and the second magnetic powder weighs 10 to 50 percent of the total weight of the first magnetic powder and the second magnetic powder.

18 Claims, 8 Drawing Sheets

MIXED MAGNETIC POWDERS AND THE ELECTRONIC DEVICE USING THE SAME

CROSS-REFERENCES TO RELATED APPLICATIONS

This application claims the benefit of U.S. Provisional Patent Application No. 62/054,388 filed on Sep. 24, 2014 and 62/079,573 filed on Nov. 14, 2014, which are hereby incorporated by reference herein and made a part of specification.

BACKGROUND OF THE INVENTION

Field of the Invention

The present invention relates to a mixed powders for manufacturing an electronic component, in particular a mixed magnetic powders for manufacturing an inductive component.

Description of Related Art

As technology advances, inductive components have become smaller and smaller with lower power consumption especially when operating in high frequencies. Conventionally, different magnetic powders are mixed to form a magnetic body or a magnetic core by a pressure molding process for making an inductive component. The magnetic powders can be made of a soft magnetic material and the mixture of the soft magnetic powders can be mixed with adhesive material, after which the mixture of the magnetic powders and the adhesive material will undergo a molding process to form a magnetic body or a magnetic core.

In general, the higher the pressure in the molding process, the higher the core bulk density and the permeability of the core. However, if the pressure is too high, it will cause damage of the internal insulating material or residual stress which will induce the deformation of the magnetic core; therefore, the pressure can only increase the core bulk density and the permeability of the core to a certain limit.

Furthermore, conventional magnetic powders are mixed together with a single particle size distribution or different hardness between different magnetic powders, which has reached a limit for increasing the bulk density of the magnetic body or the magnetic core. Therefore, how to improve both the core bulk density and initial permeability without higher pressure is a desired goal in the industry.

SUMMARY OF THE INVENTION

The present invention provides a soft magnetic material with mixed magnetic powders having a distribution of various particle sizes to form a magnetic body or a magnetic core with higher bulk density and permeability.

In one embodiment, a mixed magnetic powders for making a magnetic core or body is disclosed, wherein the mixed magnetic powders comprises: a first magnetic powder; a second magnetic powder, wherein the first magnetic powder and the second magnetic powder are made of a same soft magnetic material, wherein the ratio of the D50 of the first magnetic powder to the D50 of the second magnetic powder is in the range of 5 to 12, wherein the first magnetic powder weighs 50 to 90 percent of the total weight of the first magnetic powder and the second magnetic powder; and the second magnetic powder weighs 10 to 50 percent of the total weight of the first magnetic powder and the second magnetic powder.

In one embodiment, the mixed magnetic powders according to claim 1, wherein the mixed magnetic powders are made of amorphous alloy powder.

In one embodiment, the Nano-indentation hardness of the amorphous alloy powder is not less than 7 Gpa.

In one embodiment, the ratio of the D50 of the first magnetic powder to the D50 of the second magnetic powder is in the range of 6 to 9.

In one embodiment, the ratio of the D50 of the first magnetic powder to the D50 of the second magnetic powder is in the range of 10 to 12.

In one embodiment, the first magnetic powder weighs 80 percent of the total weight of the first magnetic powder and the second magnetic powder; and the second magnetic powder weighs 20 percent of the total weight of the first magnetic powder and the second magnetic powder.

In one embodiment, the first magnetic powder weighs 70 percent of the total weight of the first magnetic powder; and the second magnetic powder and the second magnetic powder weighs 30 percent of the total weight of the first magnetic powder and the second magnetic powder.

In one embodiment, the mixed magnetic powders are made of amorphous alloy powder, wherein the weight ratio of the first magnetic powder and the second magnetic powder is 6:4 when the ratio of the D50 of the first magnetic powder to the D50 of the second magnetic powder is greater than 8.97, and the weight ratio of the first magnetic powder and the second magnetic powder is 7:3 when the ratio of the D50 of the first magnetic powder to the D50 of the second magnetic powder is less than 8.97.

In one embodiment, the D50 of the first magnetic powder is in the range of 17 to 36 um and the D50 of the second magnetic powder is in the range of 1.0 to 3.5 um.

In one embodiment, the D50 of the first magnetic powder is in the range of 20 to 34 um and the D50 of the second magnetic powder is in the range of 1.8 to 3.2 um.

In one embodiment, the D50 of the first magnetic powder is in the range of 17 to 20 um and the D50 of the second magnetic powder is in the range of 1.0 to 1.8 um.

In one embodiment, the D50 of the first magnetic powder is in the range of 17 to 36 um and the D50 of the second magnetic powder is in the range of 1.0 to 3.5 um; the D10 of the first magnetic powder is in the range of 8 to 26 um and the D10 of the second magnetic powder is in the range of 0.5 to 1.7 um; and the D90 of the first magnetic powder is in the range of 30 to 52 um and the D90 of the second magnetic powder is in the range of 2.8 to 5.6 um.

In one embodiment, the D50 of the first magnetic powder is in the range of 20 to 34 um and the D50 of the second magnetic powder is in the range of 1.8 to 3.2 um; the D10 of the first magnetic powder is in the range of 10~23 um and the D10 of the second magnetic powder is in the range of 1~1.7 um; and the D90 of the first magnetic powder is in the range of 36~52 um and the D90 of the second magnetic powder is in the range of 3.5 to 5.6 um.

In one embodiment, the D50 of the first magnetic powder is in the range of 17 to 20 um and the D50 of the second magnetic powder is in the range of 1.0 to 1.8 um; the D10 of the first magnetic powder is in the range of 8~10 um and the D10 of the second magnetic powder is in the range of 0.5~1.0 um; and the D90 of the first magnetic powder is in the range of 30~36 um and the D90 of the second magnetic powder is in the range of 2.8 to 3.5 um.

In one embodiment, the ratio of the number of particles of the first magnetic powder at D50 to the number of particles of the first magnetic powder at D10 is greater than 2 and the ratio of the number of particles of the first magnetic powder at D50 to the number of particles of the first magnetic powder at D90 is greater than 1, and wherein the ratio of the number of particles of the second magnetic powder at D50 to the number of particles of the second magnetic powder at D10 is greater than 2 and the ratio of the number of particles of the second magnetic powder at D50 to the number of particles of the second magnetic powder at D90 is greater than 1.

In one embodiment, the ratio of the D50 of the first magnetic powder to the D50 of the second magnetic powder is in the range of 10 to 12, wherein the ratio of the number of particles of the first magnetic powder at D50 to the number of particles of the first magnetic powder at D10 is greater than 3 and the ratio of the number of particles of the first magnetic powder at D50 to the number of particles of the first magnetic powder at D90 is greater than 1.5, and wherein the ratio of the number of particles of the second magnetic powder at D50 to the number of particles of the second magnetic powder at D10 is greater than 3 and the ratio of the number of particles of the second magnetic powder at D50 to the number of particles of the second magnetic powder at D90 is greater than 1.3.

In one embodiment, the mixed magnetic powders are made of iron powders.

In one embodiment, the mixed magnetic powders are made of amorphous alloy powder, wherein the first magnetic power comprising 0.5~1 wt % C, 6.2~7.2 wt % Si, 0~3.0 wt % Cr, 2.2~2.8 wt % B, and the rest is Fe, wherein 0% is less than 5000 ppm, and wherein the second magnetic power comprising 0.5~1 wt % C, 5.7~7.7 wt % Si, 0~3.0 wt % Cr, 2.0~3.0 wt % B, and the rest is Fe, wherein 0% is less than 10000 ppm.

In one embodiment, a method to produce a magnetic core or body is disclosed, the method comprising: forming a first magnetic powder and a second magnetic powder, wherein the first magnetic powder and the second magnetic powder are made of the same material, wherein the mean particle diameter of the first magnetic powder is larger than the mean particle diameter of the second magnetic powder, wherein the ratio of the D50 of the first magnetic powder to the D50 of the second magnetic powder is in the range of 5 to 12, wherein the ratio of the number of particles of the first magnetic powder at D50 to the number of particles of the first magnetic powder at D10 is greater than 2 and the ratio of the number of particles of the first magnetic powder at D50 to the number of particles of the first magnetic powder at D90 is greater than 1, and wherein the ratio of the number of particles of the second magnetic powder at D50 to the number of particles of the second magnetic powder at D10 is greater than 2 and the ratio of the number of particles of the second magnetic powder at D50 to the number of particles of the second magnetic powder at D90 is greater than 1; mixing the first magnetic powder and the second magnetic powder with an adhesive material, wherein the weight of the adhesive material is 1 to 5 percent of the total weight of the first magnetic powder and the second magnetic powder; and performing a pressure molding process to the mixture of the first magnetic powder, the second magnetic powder and the adhesive material to form the magnetic core.

In one embodiment, the adhesive material is thermoset resin.

In one embodiment, the first magnetic powder and the second magnetic powder are made of amorphous alloy, and the nano-indentation hardness of the amorphous alloy is not less than 7 Gpa.

In one embodiment, the pressure is between 0.5 t/cm$^2$ to 4 t/cm$^2$.

In one embodiment, the mixed magnetic powders are made of amorphous alloy powder, wherein the first magnetic power comprising 0.5~1 wt % C, 6.2~7.2 wt % Si, 0~3.0 wt % Cr, 2.2~2.8 wt % B, and the rest is Fe, wherein 0% is less than 5000 ppm, and wherein the second magnetic power comprising 0.5~1 wt % C, 5.7~7.7 wt % Si, 0~3.0 wt % Cr, 2.0~3.0 wt % B, and the rest is Fe, wherein 0% is less than 10000 ppm.

The present invention provides an electronic device, comprising: a magnetic body, comprising: a first magnetic powder; a second magnetic powder, wherein the first magnetic powder and the second magnetic powder are made of a same soft magnetic material, wherein the ratio of the D50 of the first magnetic powder to the D50 of the second magnetic powder is in the range of 5 to 12, wherein the first magnetic powder weighs 60 to 90 percent of the total weight of the first magnetic powder and the second magnetic powder and the second magnetic powder weighs 10 to 40 percent of the total weight of the first magnetic powder and the second magnetic powder, an adhesive material, joining the first magnetic powder and the second magnetic powder; and a wire. According to an embodiment of the present invention, a wire includes a buried part buried in the magnetic body or a winding part winding on the magnetic body. According to an embodiment of the present invention, the magnetic body is manufactured by a molding process, and the molding pressure of the molding process is 6 t/cm$^2$-11 t/cm$^2$. In one embodiment, the molding pressure of the molding process is 6 t/cm$^2$-11 t/cm$^2$.

In one embodiment, the corresponding optimum weight ratio of the first magnetic powder and second magnetic powder is 7:3. As a result, for a given the D50 ratio of the first magnetic powder and second magnetic powder, the corresponding optimum weight ratio of the first magnetic powder and second magnetic powder can be found to produce the magnetic body to achieve higher bulk density and higher initial permeability.

In order to make the aforementioned and other features and advantages of the present invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

For the following description D10, D50 and D90 are used for describing the particle size distribution of magnetic powders. D10 means 10% of the total number of the particles is less than the D10, D50 means 50% of the total number of the particles is less than D50 and D90 means 90% of the total number of the particles is less than D90.

Figure 1:
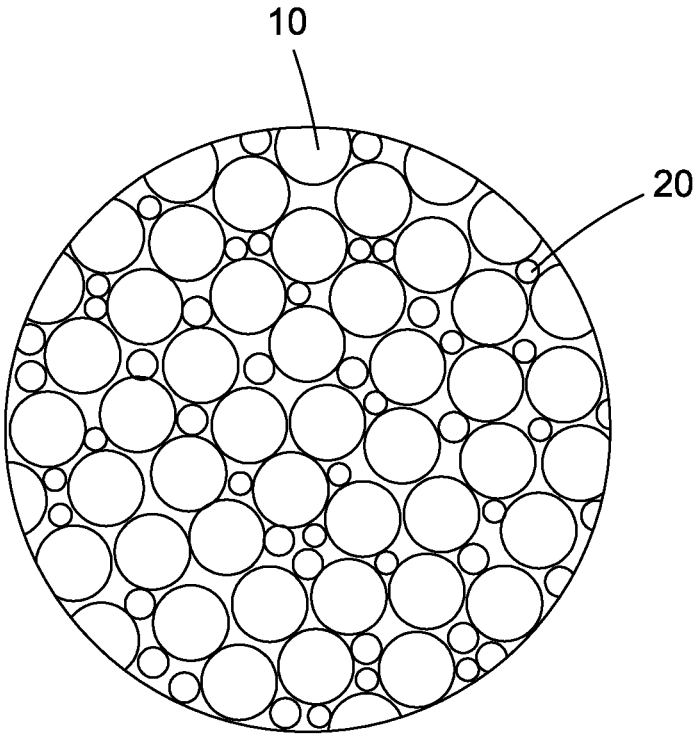
FIG. 1 is a cross-sectional view illustrating the microstructure of the soft magnetic material according to one embodiment of the present invention.

FIG. 1 depicts an enlarged view of the microstructure of a soft magnetic material according to one embodiment of the present invention. Please refer to FIG. 1, the soft magnetic material comprises a first magnetic powder 10 and a second magnetic powder 20, wherein the average particle diameter of the first magnetic powder 10 is larger than the average particle diameter of the second magnetic powder 20, wherein the ratio of the D50 of the first magnetic powder to the D50 of the second magnetic powder is in the range of 5 to 12, wherein the ratio of the number of particles of the first magnetic powder at D50 to the number of particles of the first magnetic powder at D10 is greater than 2 and the ratio of the number of particles of the first magnetic powder at D50 to the number of particles of the first magnetic powder at D90 is greater than 1, and wherein the ratio of the number of particles of the second magnetic powder at D50 to the number of particles of the second magnetic powder at D10 is greater than 2 and the ratio of the number of particles of the second magnetic powder at D50 to the number of particles of the second magnetic powder at D90 is greater than 1. Preferably, the ratio of the D50 of the first magnetic powder to the D50 of the second magnetic powder is in the range of 6 to 9, wherein the ratio of the number of particles of the first magnetic powder at D50 to the number of particles of the first magnetic powder at D10 is greater than 3 and the ratio of the number of particles of the first magnetic powder at D50 to the number of particles of the first magnetic powder at D90 is greater than 1.5, and wherein the ratio of the number of particles of the second magnetic powder at D50 to the number of particles of the second magnetic powder at D10 is greater than 3 and the ratio of the number of particles of the second magnetic powder at D50 to the number of particles of the second magnetic powder at D90 is greater than 1.3. Most preferably, the ratio of the D50 of the first magnetic powder to the D50 of the second magnetic powder is in the range of 10 to 12, wherein the ratio of the number of particles of the first magnetic powder at D50 to the number of particles of the first magnetic powder at D10 is greater than 3 and the ratio of the number of particles of the first magnetic powder at D50 to the number of particles of the first magnetic powder at D90 is greater than 1.5, and wherein the ratio of the number of particles of the second magnetic powder at D50 to the number of particles of the second magnetic powder at D10 is greater than 3 and the ratio of the number of particles of the second magnetic powder at D50 to the number of particles of the second magnetic powder at D90 is greater than 1.3.

In one embodiment, the weight ratio of the first magnetic powder 10 and the second magnetic powder 20 is 9:1, which means the first magnetic powder 10 has 90% of the total weight of the mixed magnetic powders, and the second magnetic powder 20 has 10% of the total weight of the mixed magnetic powders. Preferably, the weight ratio of the first magnetic powder 10 and the second magnetic powder 20 is 8:2, which means the first magnetic powder 10 has 80% of the total weight of the mixed magnetic powders, and the second magnetic powder 20 has 20% of the total weight of the mixed magnetic powders. Most preferably, the weight ratio of the first magnetic powder 10 and the second magnetic powder 20 is 7:3, which means the first magnetic powder 10 has 70% of the total weight of the mixed magnetic powders, and the second magnetic powder 20 has 30% of the total weight of the mixed magnetic powders.

In one embodiment, wherein the D50 of the first magnetic powder is in the range of 17 to 36 um and the D50 of the second magnetic powder is in the range of 1.0 to 3.5 um, the D10 of the first magnetic powder is in the range of 8 to 26 um and the D10 of the second magnetic powder is in the range of 0.5 to 1.7 um, the D90 of the first magnetic powder is in the range of 30 to 52 um and the D90 of the second magnetic powder is in the range of 2.8 to 5.6 um.

Preferably, the D50 of the first magnetic powder is in the range of 20~34 um and the D50 of the second magnetic powder is in the range of 1.8~3.2 um, the D10 of the first magnetic powder is in the range of 10~23 um and the D10 of the second magnetic powder is in the range of 1.0~1.7 um, the D90 of the first magnetic powder is in the range of 36 to 52 um and the D90 of the second magnetic powder is in the range of 3.5 to 5.6 um.

Most preferably, the D50 of the first magnetic powder is in the range of 17~20 um and the D50 of the second magnetic powder is in the range of 1.0~1.8 um, the D10 of the first magnetic powder is in the range of 8~10 um and the D10 of the second magnetic powder is in the range of 0.5 to 1.0 um, the D90 of the first magnetic powder is in the range of 30~36 um and the D90 of the second magnetic powder is in the range of 2.8~3.5 um.

In one embodiment, the particle size distribution of the first magnetic powder and second magnetic powder comprising: the ratio of the number of particles of the first magnetic powder at D50 (Qd50) and the number of particles of the first magnetic powder at D10 (Qd10) is greater than 2, which means (Qd50/Qd10) is greater than 2 for the first magnetic powder, the ratio of the number of particles of the first magnetic powder at D50 (Qd50) and the number of particles of the first magnetic powder at D90 (Qd90) is greater than 1, which means (Qd50/Qd90) is greater than 1 for the first magnetic powder; and the ratio of the number of particles of the second magnetic powder at D50 (Qd50) and the number of particles of the second magnetic powder at D10 (Qd10) is greater than 2, which means (Qd50/Qd10) is greater than 2 for the second magnetic powder, the ratio of the number of particles of the second magnetic powder at D50 (Qd50) and the number of particles of the second magnetic powder at D90 (Qd90) is greater than 1, which means (Qd50/Qd90) is greater than 1 for the second magnetic powder;

Based on the above descriptions, the first magnetic powder 10 and the second magnetic powder 20 can be mixed together according to a weight ratio, wherein the first magnetic powder 10 and the second magnetic powder 20 have a particular particle size distribution such that the second magnetic powder 20 can be easily filled into the spaces between the particles of the first magnetic powder 10, thereby increasing the bulk density of the mixed magnetic powders compared to conventional technology.

In one embodiment, each of the first material 10 and the second magnetic powder magnetic powder 20 comprises a metal alloy powder. The metal alloy powder can be one of the following: Fe—Cr—Si alloy powder, Fe—Ni alloy powder, amorphous alloy powder, Fe—Si, Fe—Al or other suitable alloy powder.

In one embodiment, the material of each of the first material 10 and the second magnetic powder magnetic powder 20 comprises iron or iron alloy.

In one embodiment, the first magnetic powder 10 and second magnetic powder 20 are made of amorphous alloy powders, and the nano-indentation hardness of amorphous alloy powder is not less than 7 Gpa. Preferably, the first magnetic powder 10 is composed of the following materials expressed by percentage of mass: 0.5 to 1% of carbon (C), 6.2~7.2% of silicon (Si), 0~3.0% of chromium (Cr), 2.2 to 2.8% of boron (B), and the remaining proportion of iron (Fe), where 0% is less than 5000 ppm; the second magnetic powder 20 is composed of the following materials expressed by percentage of mass: 0.5 to 1% of carbon (C), 5.7 to 7.7% of silicon (Si), 0~3.0% of chromium (Cr), 2.0~3.0% of boron (B), and the remaining proportion of iron (Fe), where 0% is less than 10000 ppm.

Figure 2:
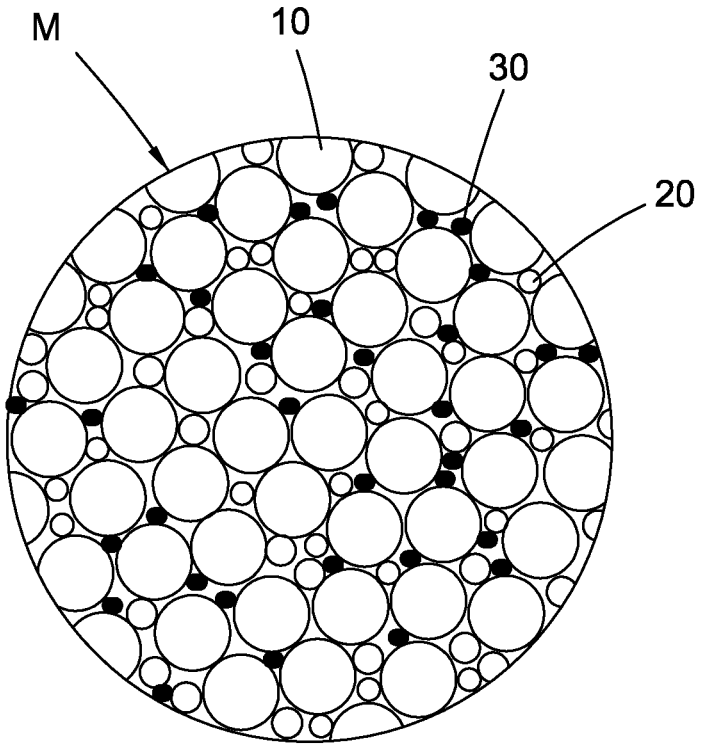
FIG. 2 is a cross-sectional view illustrating the microstructure of the soft magnetic material according to another embodiment of the present invention.

FIG. 2 depicts an enlarged view of the microstructure of a soft magnetic material according to one embodiment of the present invention. Please refer to FIG. 2, the soft magnetic material comprises the first magnetic powder 10 and the second magnetic powder 20 as described in FIG. 1, and adhesive material 30 mixed with the first magnetic powder 10 and the second magnetic powder 20, wherein the weight of the adhesive material is 1 to 5 percent of the total weight of the first magnetic powder and the second magnetic powder. The adhesive material 30 may be thermosetting resins such as epoxy resin. Preferably, the first magnetic powder and second magnetic powder 10 20 are amorphous alloy powders.

Figure 3:
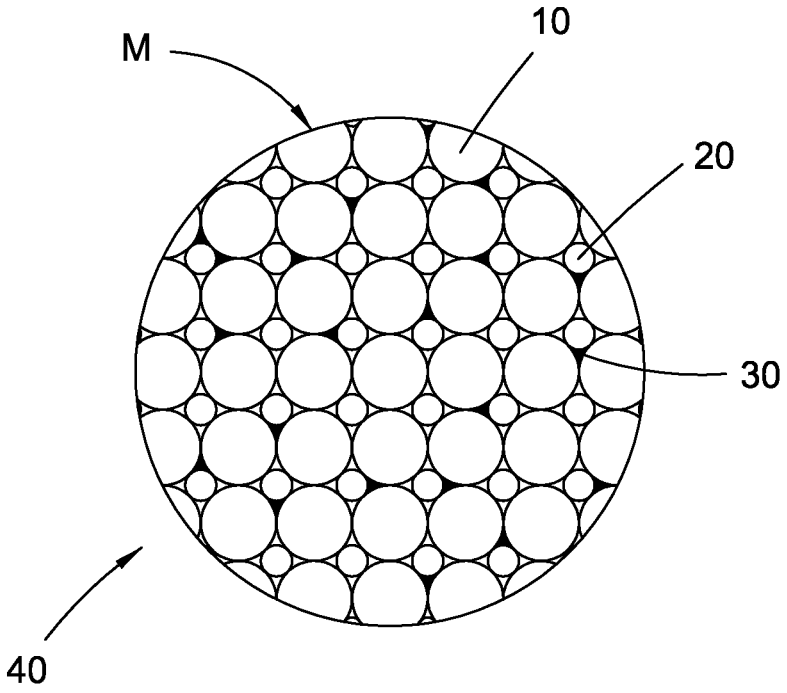
FIG. 3 is a cross-sectional view of the magnetic body made of the soft magnetic material according to one embodiment of the present invention.

In another aspect of the present invention, a method to produce a magnetic body 40 is disclosed, wherein the method comprises: forming a soft magnetic material mixture M comprising a first magnetic powder and a second magnetic powder, wherein the first magnetic powder and the second magnetic powder are made of the same material, wherein the mean particle diameter of the first magnetic powder is larger than the mean particle diameter of the second magnetic powder, wherein the ratio of the D50 of the first magnetic powder to the D50 of the second magnetic powder is in the range of 5 to 12, wherein the ratio of the number of particles of the first magnetic powder at D50 to the number of particles of the first magnetic powder at D10 is greater than 2 and the ratio of the number of particles of the first magnetic powder at D50 to the number of particles of the first magnetic powder at D90 is greater than 1, and wherein the ratio of the number of particles of the second magnetic powder at D50 to the number of particles of the second magnetic powder at D10 is greater than 2 and the ratio of the number of particles of the second magnetic powder at D50 to the number of particles of the second magnetic powder at D90 is greater than 1; mixing the first magnetic powder and the second magnetic powder with an adhesive material, wherein the weight of the adhesive material is 1 to 5 percent of the total weight of the first magnetic powder and the second magnetic powder; and performing a pressure molding process to the mixture of the first magnetic powder, the second magnetic powder and the adhesive material to form a magnetic body 40, as shown in FIG. 3.

In one embodiment, the molding pressure is 0.1 tons per square centimeter to 6 tons per square. In one embodiment, the method includes a heating process at a temperature 300° C.

FIG. 3 depicts a sectional view of a magnetic body 40 which has a higher bulk density by using the mixture of the soft magnetic material M with a particular particle size distribution of magnetic powders, wherein a pressure molding process is applied to the mixture of the soft magnetic material M to form a magnetic body 40, whereby the initial permeability can be enhanced compared to conventional technology. The magnetic body 40 can be used as a magnetic core of an inductive component having a higher permeability, lower power consumption and lower core loss compared to conventional technology. On the other hand, if the magnetic body 40 is targeted to a given bulk density, the pressure for molding the soft magnetic material M can be reduced compared to conventional technology for producing the same bulk density.

Figure 4:
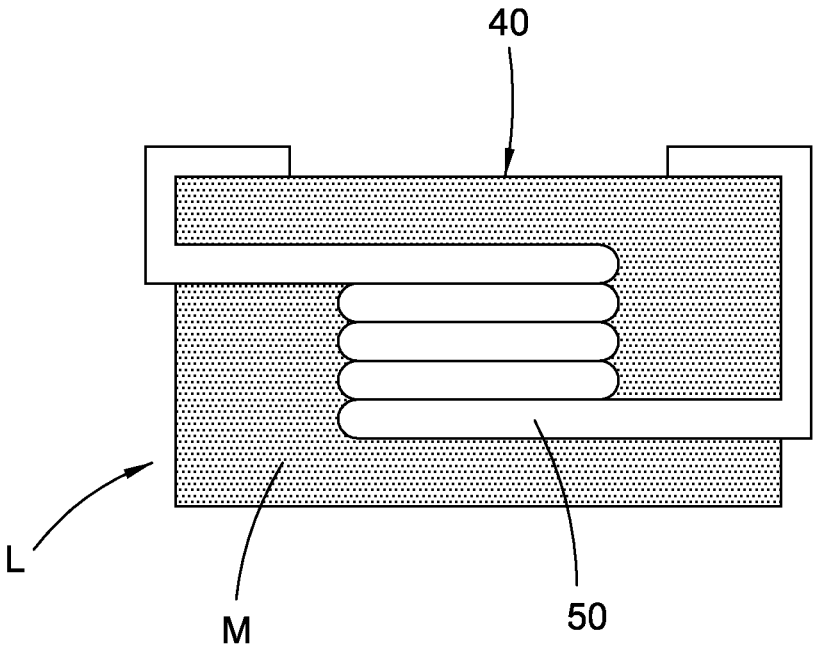
FIG. 4 is a cross-sectional view of the magnetic body with an embedded coil according to one embodiment of the present invention.

FIG. 4 depicts a sectional view of a magnetic body 40 which is made by using the mixture of the soft magnetic material M and a coil 50 embedded in the mixture of the soft magnetic material through a pressure molding process. Inductor L is made of a sectional structure view of an embodiment, the coil 50 is made of enameled wire having an insulating outer layer, and since the soft magnetic material of the present invention has a higher bulk density, the molding pressure to form the magnetic material 40 can be reduced compared with the conventional mixed powders, thereby preventing damage or deformation of the magnetic body 40 during the pressure molding process.

Based on the above descriptions, the magnetic body made of the mixture of the soft magnetic material M has the following advantages compared to conventional technology: (1) since the D50 of the each of the first and the second magnetic powder is smaller, it can decrease eddy current loss; (2) since the first and the second magnetic powder have a particular particle size distribution, it can achieve a higher bulk density; (3) the molding pressure to form the magnetic material 40 can be reduced for a given bulk density produced by conventional technology, thereby preventing damage or deformation of the magnetic body during the pressure molding process. In addition, if the amorphous alloy powder with a larger hardness is used for the first and the second magnetic powder, it can reduce the residual stress during molding, thereby reducing the coercive force and the magnetic losses.

The following experiments are carried out for demonstrating the technical features, effect and advantages describes above.

The experiment I shows the particle size distributions of the first magnetic powder 10 and the second magnetic powder 20 as described above that impacts the bulk density, energy loss, and other characteristic of the magnetic body.

The Table 1 shows the bulk density, energy loss, and other characteristic of the magnetic body according to the experiment I.

Under the condition that the D50 of the second magnetic powder 20 is fixed at 3.21 μm, Table 1 shows that the weight ratio of the first magnetic powder 10 and second magnetic powder 20 is 6:4 in case 1. As shown in cases 2, 3, 4, when the D50 of the first magnetic powder 10 is reduced from 33.5 μm of the case 1 to 28.8 μm of the case 2, 20.4 μm of the case 3, 17.6 μm of the case 4, the high frequency loss Pcv (1 MHz/20 mT) is reduced to 701.4 kw/m$^3$, 664.8 kw/m$^3$ and 643.8, 607.5 kw/m$^3$ in cases 2, 3 and 4, respectively, because when the D50 of the first magnetic powder 10 is reduced, the eddy current will be reduced, thereby reducing the high frequency loss. However, when the D50 of the first magnetic powder 10 is reduced in cases 2, 3, and 4 compared with that of the case 1, the density of magnetic body will be decreased from 5.66 g/cm$^3$ of case 1, to 5.63 g/cm$^3$, 5.62 g/cm$^3$ and 5.38 g/cm$^3$ in cases 2, 3 and 4, respectively, which resulting in lower initial permeability rate from 28.5 of case 1 to 27.6, 26.2 and 21.8 in cases 2, 3 and 4, respectively, while the low frequency energy loss Pcv (100 KHz/20 mT) increased from 31.8 kw/m$^3$ of case 1 to 32.4, 36.1 and 42 kw/m$^3$ in cases 2, 3 and 4, respectively, due to the fact that the permeability is reduced when the D50 of the first magnetic powder 10 is reduced causing higher hysteresis loss. As a result, as the D50 of the first magnetic powder 10 is reduced, the weight ratio of the first magnetic powder and second magnetic powder should be adjusted to increase the bulk density and the permeability.

Please note that, in the following Table 1, 2 and 3, "L*" represents "Large powder" or the first magnetic powder; "S*" represents "Small powder" or the second magnetic powder; "D*" represents Density; "L*/S*Wt Ratio" represents the weight ratio of the large power to the small power; "Ad*wt %" represents "weight percentage of Adhesive material"; "P" represents "Pressure" and "initial Perm" represents "initial permeability"; Pcv*represents (kw/m$^3$) 100 kHz/20 mT and Pcv**represents (kw/m$^3$) 1 MHz/20 mT

TABLE 1

| Type | exp | L* D10 um | S* D10 um | L* D90 um | S* D90 um | L* D50 um | S* D50 um | L*D50/ S*D50 | D* g/cm$^3$ | L*/S* Wt Ratio | Ad* wt % | P* t/cm$^2$ | Initial Perm | Hc A/m | Pcv* | Pcv** |
|---|---|---|---|---|---|---|---|---|---|---|---|---|---|---|---|---|
| Case for comparison | 1 | 22.60 | 1.66 | 52.20 | 5.58 | 33.50 | 3.21 | 10.44 | 5.66 | 6:4 | 5 | 0.5 | 28.5 | 7.88 | 31.8 | 701.4 |
| Other cases | 2 | 17.88 | 1.66 | 42.90 | 5.58 | 28.80 | 3.21 | 8.97 | 5.63 | 6:4 | 5 | 0.5 | 27.5 | 7.34 | 32.4 | 664.8 |
| | 3 | 10.16 | 1.66 | 36.25 | 5.58 | 20.40 | 3.21 | 6.36 | 5.62 | 6:4 | 5 | 0.5 | 26.2 | 8.01 | 36.1 | 643.8 |
| | 4 | 8.90 | 1.66 | 31.07 | 5.58 | 17.60 | 3.21 | 5.48 | 5.38 | 6:4 | 5 | 0.5 | 21.8 | 8.31 | 42 | 607.5 |

The experiment II shows an optimum weight ratio and D50 ratio between the first magnetic powder 10 and the second magnetic powder 20 as described above.

The Table 2 shows the magnetic body 40 made according to one embodiment of the present invention, wherein the weight ratio and the D50 ratio between the first magnetic powder 10 and the second magnetic powder 20 are illustrated along with other characteristics of magnetic body 40.

TABLE 2

| Type | exp | L* D10 um | S* D10 um | L* D90 um | S* D90 um | L* D50 um | S* D50 um | L*D50/ S*D50 | D* g/cm$^3$ | L*/S* Wt Ratio | Ad* wt % | P* t/cm$^2$ | Initial Perm | Hc A/m | Pcv* | Pcv** |
|---|---|---|---|---|---|---|---|---|---|---|---|---|---|---|---|---|
| Case for comparison | 1 | 22.6 | 1.66 | 52.2 | 5.58 | 33.5 | 3.21 | 10.44 | 5.66 | 6:4 | 5 | 0.5 | 28.5 | 7.88 | 31.8 | 701.4 |
| Other cases | 1-1 | 22.6 | 1.66 | 52.2 | 5.58 | 33.5 | 3.21 | 10.44 | 5.5 | 7:3 | 5 | 0.5 | 25.9 | 8.22 | 33.7 | 716.7 |
| | 2 | 17.88 | 1.66 | 42.9 | 5.58 | 28.8 | 3.21 | 8.97 | 5.63 | 6:4 | 5 | 0.5 | 27.5 | 7.34 | 32.4 | 664.8 |
| | 3 | 10.16 | 1.66 | 36.25 | 5.58 | 20.4 | 3.21 | 6.36 | 5.62 | 6:4 | 5 | 0.5 | 26.3 | 8.01 | 36.1 | 643.8 |
| | 3-1 | 10.16 | 1.66 | 36.25 | 5.58 | 20.4 | 3.21 | 6.36 | 5.66 | 7:3 | 5 | 0.5 | 27.7 | 7.67 | 33 | 629 |
| | 4 | 8.9 | 1.03 | 31.07 | 5.58 | 17.6 | 3.21 | 5.48 | 5.38 | 6:4 | 5 | 0.5 | 21.8 | 8.31 | 42 | 607.5 |
| | 4-1 | 8.9 | 1.03 | 31.07 | 5.58 | 17.6 | 3.21 | 5.48 | 5.54 | 7:3 | 5 | 0.5 | 26.7 | 7.7 | 34.2 | 625.2 |

As shown in Table 2, as the D50 ratio of the first magnetic powder 10 and second magnetic powder 20 (that is, D50 of the first magnetic powder/D50 of the second magnetic powder) changes, the optimum weight ratio of the first magnetic powder 10 and the second magnetic powder 20 also changes.

Figure 5:
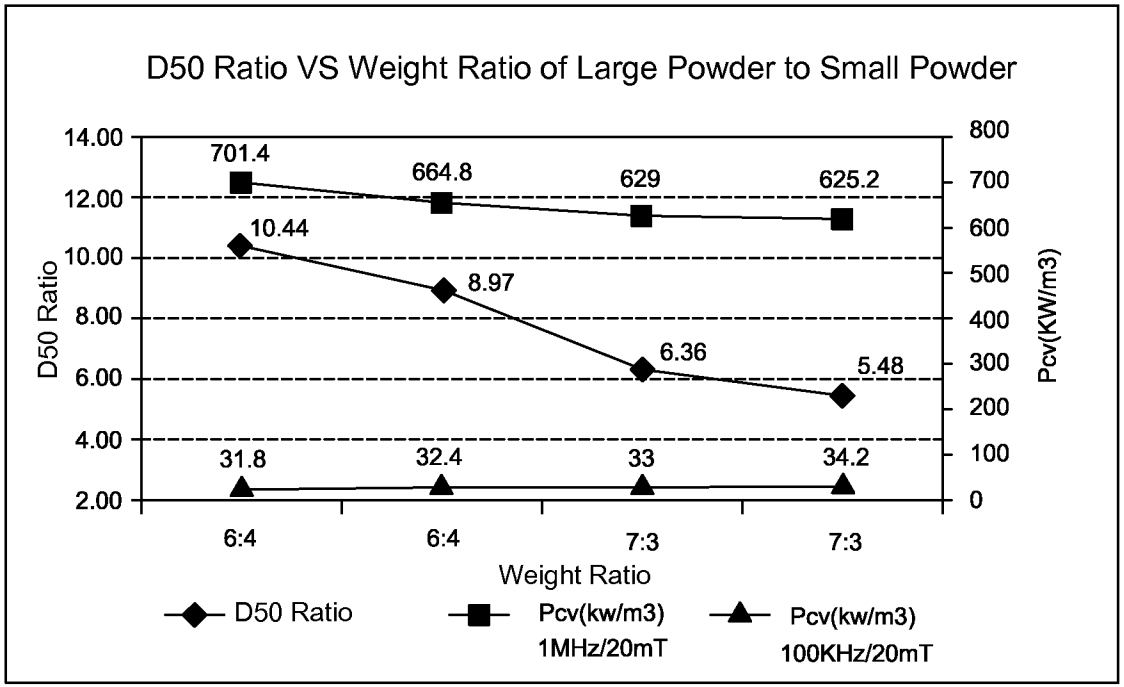
FIG. 5 and FIG. 6 illustrate the impacts of the weight ratio of a first magnetic powder and a second magnetic powder.
Figure 6:
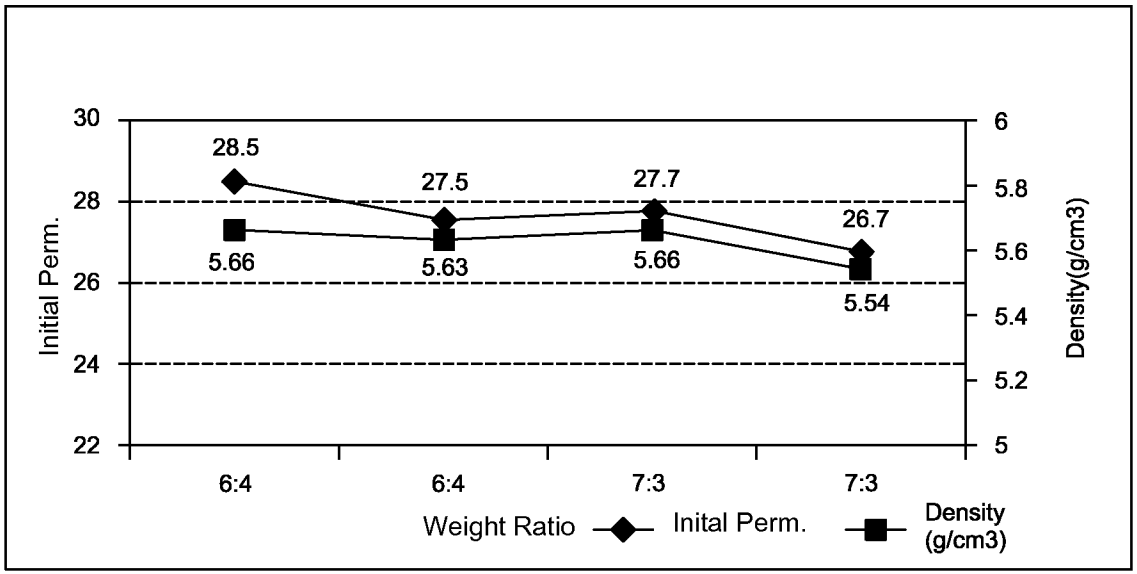

FIG. 5 and FIG. 6 illustrates the corresponding optimum weight ratio of the first magnetic powder 10 and second magnetic powder 20 as the D50 ratio of the first magnetic powder 10 and second magnetic powder 20 changes. As shown in FIG. 5 and FIG. 6, when the D50 ratio of the first magnetic powder 10 and second magnetic powder 20 is greater than 8.97, the corresponding optimum weight ratio of the first magnetic powder 10 and second magnetic powder is 6:4; when the D50 ratio of the first magnetic powder 10 and second magnetic powder 20 is less than 8.97, the corresponding optimum weight ratio of the first magnetic powder 10 and second magnetic powder is 7:3. As a result, for a given D50 ratio of the first magnetic powder 10 and second magnetic powder 20, the corresponding optimum weight ratio of the first magnetic powder 10 and second magnetic powder 20 can be found to produce the magnetic body 40 to achieve higher bulk density and higher initial permeability, wherein the initial permeability can be maintained between 27 to 28, while keeping the low-energy loss variation small as the hysteresis loss is not worsen too much. It is worth noting that, even the D50 of the first magnetic powder 10 is decreased, the high-frequency loss can still be reduced. Based on the experiment II, one can find an optimum combination of the D50 ratio and the weight ratio between the first magnetic powder 10 and second magnetic powder 20; and even if the particles of the first magnetic powder 10 and second magnetic powder 20 become smaller, the permeability can be kept constant while reducing the energy loss at both high and low frequency bands.

The following describes how to improve the initial permeability of the magnetic body made of amorphous alloy powder according to one embodiment of the present invention.

Table 3 shows test results of the magnetic body 40 made by using a mixture of the soft magnetic material M with different weight percentage of the adhesive material 30, or different D50 of the second magnetic powder 20, or different pressures for molding the magnetic body 40, so as to increase the density and improve the initial permeability of the magnetic body 40.

According to the aforementioned experiments experimental results, through the adjustment of the weight ratio and D50 ratio of the first magnetic powder 10 and the second magnetic powder 20, the density of the magnetic body 40 can be increased, but the highest initial permeability reaches only about 28. Accordingly, the present invention proposes a way to further enhance the initial permeability by reducing the weight percentage of the adhesive material 30 in the mixture of the soft magnetic material M or adjusting the molding pressure to a range from 0.5 t/cm$^2$ to 1 t/cm$^2$ to reduce the spaces or gaps between the magnetic powders, so that the density of the magnetic body 40 and the initial permeability can be further enhanced.

The experimental results are shown in Table 3, when the molding pressure is from 0.5 tons per square centimeter to one ton per square centimeter, the density of the magnetic body 40 can be increased from 5.66 g/cm$^3$ to 5.68 g/cm$^3$, and the initial permeability increase of 3 to 7% while the energy loss Pcv at lower frequencies (100 KHz/20 mT) has no significant change, but the energy loss at the high frequencies has an about 7 to 10 percent increase by the increased eddy current loss as the spaces or gaps between the magnetic particles decreased.

TABLE 3

| Type | exp | L* D10 um | S* D10 um | L* D90 um | S* D90 um | L* D50 um | S* D50 um | L*D50/ S*D50 | D* g/cm$^3$ | L*/S* Wt Ratio | Ad* wt % | P* t/cm$^2$ | Initial Perm | Hc A/m | Pcv* | Pcv** |
|---|---|---|---|---|---|---|---|---|---|---|---|---|---|---|---|---|
| Case for comparison | 1 | 22.6 | 1.66 | 52.2 | 5.58 | 33.5 | 3.21 | 10.44 | 5.66 | 6:4 | 5 | 0.5 | 28.5 | 7.88 | 31.8 | 701.4 |
| Other cases | 1-2 | 22.6 | 1.66 | 52.2 | 5.58 | 33.5 | 3.21 | 10.44 | 5.68 | 6:4 | 5 | 1 | 30.5 | 8.69 | 32.1 | 769.6 |
| | 3-1 | 10.16 | 1.66 | 36.25 | 5.58 | 20.4 | 3.21 | 6.36 | 5.66 | 7:3 | 5 | 0.5 | 27.7 | 7.67 | 33 | 629 |
| | 3-2 | 10.16 | 1.66 | 36.25 | 5.58 | 20.4 | 3.21 | 6.36 | 5.68 | 7:3 | 5 | 1 | 28.6 | 8.2 | 32.5 | 671.2 |
| | 5 | 1.03 | 1.66 | 31.07 | 3.54 | 17.6 | 1.5 | 11.73 | 5.64 | 7:3 | 5 | 0.5 | 29.4 | 6.09 | 25.9 | 520.9 |
| | 6 | 1.03 | 1.66 | 31.07 | 3.54 | 17.6 | 1.5 | 11.73 | 5.68 | 7:3 | 5 | 1 | 30.7 | 7.02 | 27.9 | 606.9 |

Figure 7:
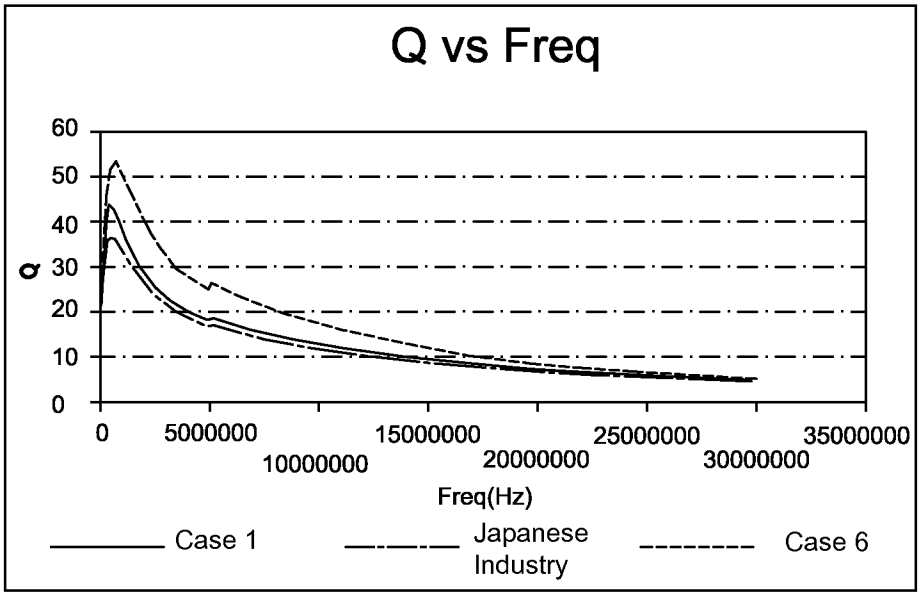
FIG. 7 shows the Q factor vs the frequencies of an inductor made by the present invention compared with conventional technology.

In order to achieve lower energy loss and higher initial permeability at the same time, the D50 of the second magnetic powder 20 or the weight percentage of the adhesive material 30 are adjusted. As shown in Table 3, the initial permeability in the case 5 and case 6 has increased to 29 to 30. The energy loss at lower frequencies or high frequencies is lowest among all the cases. By doing so, the magnetic body 40 can be used to produce an inductor with higher Q factor. FIG. 7 shows the Q factor vs the frequencies of an inductor made by the present invention compared with conventional technology. As shown in FIG. 7, a peak Q factor of the inductor is greater than 50 at a frequency below 5 MHz.

Figure 8:
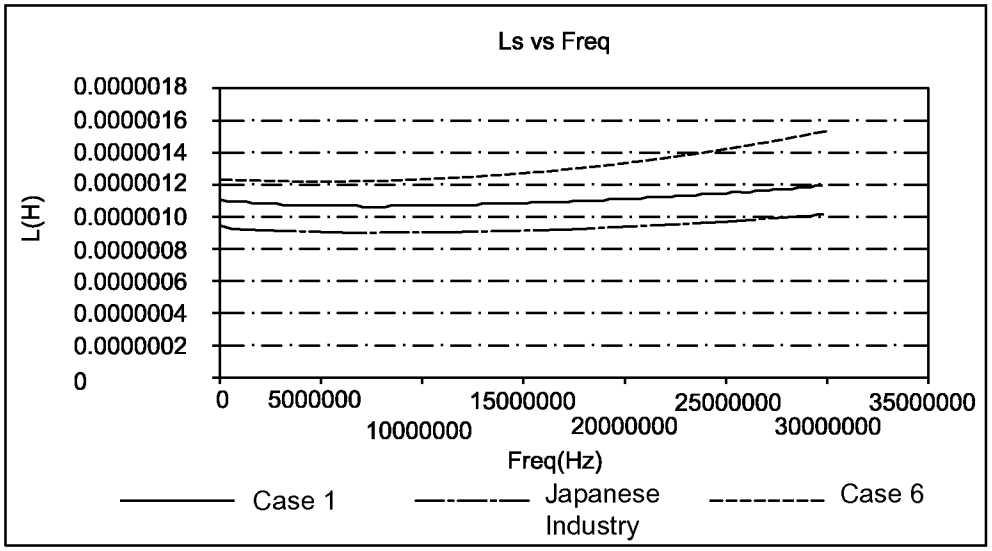
FIG. 8 shows the inductance vs the frequencies of the inductor made by the present invention compared with conventional technology.

FIG. 8 shows the inductance vs the frequencies of the inductor made by the present invention compared with conventional technology. As a result, the inductor made by the molding body produced in case 6 has achieved a higher inductance compared with the conventional technology such as inductors made from Japanese inductor industries.

Although the present invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A mixed magnetic powders for making a magnetic core, comprising:

a first magnetic powder;

a second magnetic powder, wherein each of the first magnetic powder and the second magnetic powder is made of amorphous alloy, wherein the ratio of the D50 of the first magnetic powder to the D50 of the second magnetic powder is in the range of 5 to 12, wherein the first magnetic powder weighs 50 to 90 percent of the total weight of the first magnetic powder and the second magnetic powder; and the second magnetic powder weighs 10 to 50 percent of the total weight of the first magnetic powder and the second magnetic powder, wherein the nano-indentation hardness of each of the first magnetic powder and the second magnetic powder is not less than 7 Gpa.

2. The mixed magnetic powders according to claim 1, wherein the first magnetic powder weighs 60 to 80 percent of the total weight of the first magnetic powder and the second magnetic powder and the second magnetic powder weighs 20 to 40 percent of the total weight of the first magnetic powder and the second magnetic powder.

3. The mixed magnetic powders according to claim 1, wherein the first magnetic powder weighs 60 to 70 percent of the total weight of the first magnetic powder and the second magnetic powder; and the second magnetic powder weighs 30 to 40 percent of the total weight of the first magnetic powder and the second magnetic powder.

4. The mixed magnetic powders according to claim 1, wherein the mixed magnetic powders are made of amorphous alloy powder, wherein the weight ratio of the first magnetic powder and the second magnetic powder is substantially at 6:4 and the ratio of the D50 of the first magnetic powder to the D50 of the second magnetic powder is greater than 8.97.

5. The mixed magnetic powders according to claim 1, wherein the mixed magnetic powders are made of amorphous alloy powder, wherein the weight ratio of the first magnetic powder and the second magnetic powder is substantially at 7:3 and the ratio of the D50 of the first magnetic powder to the D50 of the second magnetic powder is less than 8.97.

6. The mixed magnetic powders according to claim 1, wherein the D50 of the first magnetic powder is in the range of 17 to 36 um and the D50 of the second magnetic powder is in the range of 1.0 to 3.5 um.

7. The mixed magnetic powders according to claim 1, wherein the D50 of the first magnetic powder is in the range of 20 to 34 um and the D50 of the second magnetic powder is in the range of 1.8 to 3.2 um.

8. The mixed magnetic powders according to claim 1, wherein the D50 of the first magnetic powder is in the range of 17 to 20 um and the D50 of the second magnetic powder is in the range of 1.0 to 1.8 um.

9. The mixed magnetic powders according to claim 1, wherein the D50 of the first magnetic powder is in the range of 17 to 36 um and the D50 of the second magnetic powder is in the range of 1.0 to 3.5 um; the D10 of the first magnetic powder is in the range of 8 to 26 um and the D10 of the second magnetic powder is in the range of 0.5 to 1.7 um; and the D90 of the first magnetic powder is in the range of 30 to 52 um and the D90 of the second magnetic powder is in the range of 2.8 to 5.6 um.

10. The mixed magnetic powders according to claim 1, wherein the D50 of the first magnetic powder is in the range of 20 to 34 um and the D50 of the second magnetic powder is in the range of 1.8 to 3.2 um; the D10 of the first magnetic powder is in the range of 10~23 um and the D10 of the second magnetic powder is in the range of 1~1.7 um; and the D90 of the first magnetic powder is in the range of 36~52 um and the D90 of the second magnetic powder is in the range of 3.5 to 5.6 um.

11. The mixed magnetic powders according to claim 1, wherein the D50 of the first magnetic powder is in the range of 17 to 20 um and the D50 of the second magnetic powder is in the range of 1.0 to 1.8 um; the D10 of the first magnetic powder is in the range of 8~10 um and the D10 of the second magnetic powder is in the range of 0.5~1.0 um; and the D90 of the first magnetic powder is in the range of 30~36 um and the D90 of the second magnetic powder is in the range of 2.8 to 3.5 um.

12. The mixed magnetic powders according to claim 1, wherein the ratio of the number of particles of the first magnetic powder at D50 to the number of particles of the first magnetic powder at D10 is greater than 2 and the ratio of the number of particles of the first magnetic powder at D50 to the number of particles of the first magnetic powder at D90 is greater than 1, and wherein the ratio of the number of particles of the second magnetic powder at D50 to the number of particles of the second magnetic powder at D10 is greater than 2 and the ratio of the number of particles of the second magnetic powder at D50 to the number of particles of the second magnetic powder at D90 is greater than 1.

13. The mixed magnetic powders according to claim 1, wherein the ratio of the D50 of the first magnetic powder to the D50 of the second magnetic powder is in the range of 10 to 12, wherein the ratio of the number of particles of the first magnetic powder at D50 to the number of particles of the first magnetic powder at D10 is greater than 3 and the ratio of the number of particles of the first magnetic powder at D50 to the number of particles of the first magnetic powder at D90 is greater than 1.5, and wherein the ratio of the number of particles of the second magnetic powder at D50 to the number of particles of the second magnetic powder at D10 is greater than 3 and the ratio of the number of particles of the second magnetic powder at D50 to the number of particles of the second magnetic powder at D90 is greater than 1.3.

14. The mixed magnetic powders according to claim 1, wherein the mixed magnetic powders are made of iron powders.

15. The mixed magnetic powders according to claim 1, wherein the mixed magnetic powders are made of amorphous alloy powder, wherein the first magnetic power comprising 0.5~1 wt % C, 6.2~7.2 wt % Si, 0~3.0 wt % Cr, 2.2~2.8 wt % B, and the rest is Fe, wherein 0% is less than 5000 ppm, and wherein the second magnetic power comprising 0.5~1 wt % C, 5.7~7.7 wt % Si, 0~3.0 wt % Cr, 2.0~3.0 wt % B, and the rest is Fe, wherein 0% is less than 10000 ppm.

16. An electronic device, comprising:

a magnetic body, comprising:

a first magnetic powder; and a second magnetic powder, wherein each of the first magnetic powder and the second magnetic powder is made of amorphous alloy, wherein the ratio of the D50 of the first magnetic powder to the D50 of the second magnetic powder is in a range of 5 to 12, wherein the first magnetic powder weighs 60 to 90 percent of the total weight of the first magnetic powder and the second magnetic powder and the second magnetic powder weighs 10 to 40 percent of the total weight of the first magnetic powder and the second magnetic powder, wherein the nano-indentation hardness of each of the first magnetic powder and the second magnetic powder is not less than 7 Gpa; and a wire, disposed in the magnetic body.

17. The electronic device according to claim 16, wherein the electronic device is an inductor, further comprising adhesive material to mix with the first magnetic power and the second magnetic powder.

18. The electronic device according to claim 17, wherein the peak Q factor of the inductor is greater than 50 at a frequency below 5 Mhz.

* * * * *